United States Patent [19]

Goldfarb et al.

[11] 4,344,249

[45] Aug. 17, 1982

[54] PLAY SET

[76] Inventors: Adolph E. Goldfarb, 4614 Monarca Dr., Tarzana, Calif. 91356; Elonne Dantzer, 28030 Palos Verdes Dr. E., Rancho Palos Verde, Calif. 90274

[21] Appl. No.: 196,839

[22] Filed: Oct. 14, 1980

Related U.S. Application Data

[63] Continuation-in-part of Ser. No. 11,445, Feb. 12, 1979, Pat. No. 4,227,340.

[51] Int. Cl.[3] ..... A63H 3/00

[52] U.S. Cl. ..... 46/151; 46/172; 46/22

[58] Field of Search ..... 46/22, 116, 151, 156, 46/157, 160, 172; 434/396

[56] References Cited

U.S. PATENT DOCUMENTS

| | | | |
|---|---|---|---|
| 1,255,677 | 2/1918 | Wilt | 46/157 |
| 1,627,511 | 5/1927 | Hopf | 46/172 |
| 2,707,102 | 4/1955 | Wendt | 46/151 |
| 2,944,368 | 7/1960 | O'Brian et al. | 46/22 |
| 3,073,059 | 1/1963 | Doyle et al. | 46/157 |
| 3,156,999 | 11/1964 | Dean et al. | 46/172 |
| 3,168,983 | 2/1965 | Bosak | 46/116 |
| 3,205,614 | 9/1965 | Brosk | 46/116 |
| 3,313,044 | 4/1967 | Glass et al. | 35/56 |
| 3,520,078 | 7/1970 | Klamer | 46/22 |
| 3,668,805 | 6/1972 | Coleman | 46/151 |
| 4,227,340 | 10/1980 | Goldfarb et al. | 46/151 |

FOREIGN PATENT DOCUMENTS

| | | | |
|---|---|---|---|
| 338542 | 6/1921 | Fed. Rep. of Germany | 46/172 |

*Primary Examiner*—Hugh R. Chamblee
*Assistant Examiner*—John J. Wilson
*Attorney, Agent, or Firm*—Romney, Golant, Martin, Disner & Ashen

[57] ABSTRACT

A play set comprising a three-dimensional doll figure and a variety of flexible, resilient clip-on pieces representing clothing for the doll to wear, vehicles and animals for the doll to ride in and/or on, etc. The doll has an original appearance, i.e. original clothes, pose, etc. The clip-on pieces may cover over portions of the original appearance and replace them in addition to adding to them. For example, original arm positions and a shirt may be replaced by different arm positions and a coat. Similarly, legs of a standing figure may be replaced by a motorcycle and legs positioned astride the motorcycle. In preferred form, the figure is bias-relief, having a flat rear surface defining a peripheral shoulder and the clip-on pieces each conform generally to the front of the bias-relief figure and have retaining lips that engage the peripheral shoulder.

1 Claim, 8 Drawing Figures

FIG. 1
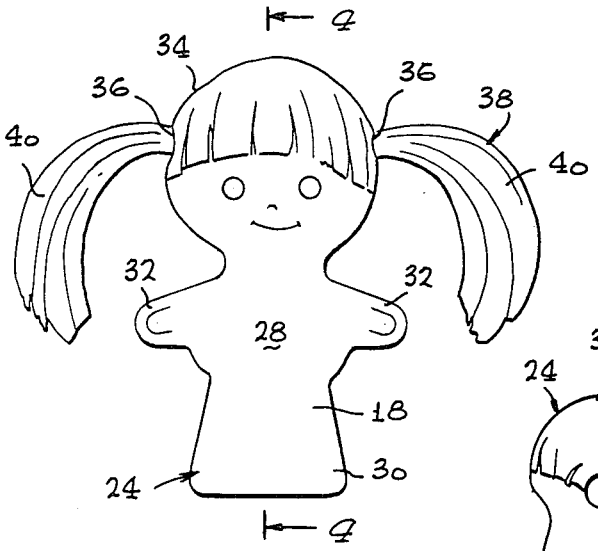
FIG. 5
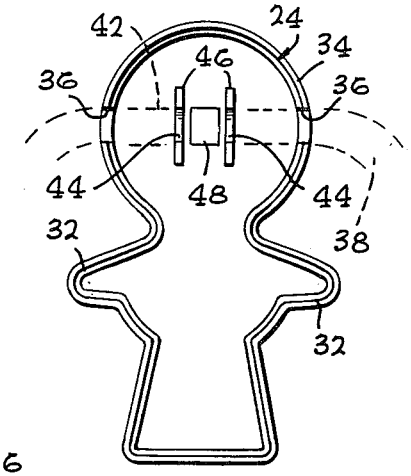
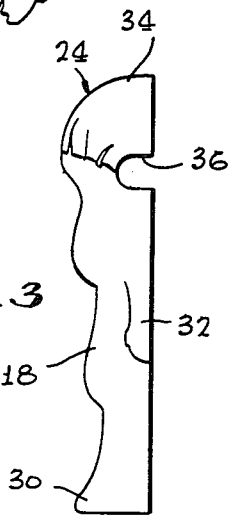
FIG. 3
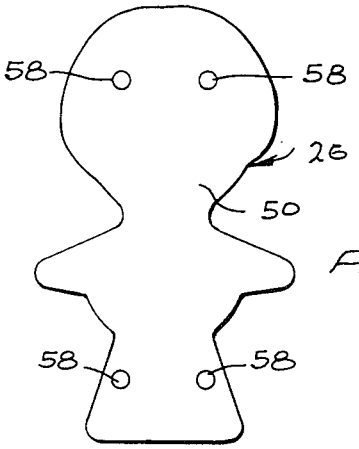
FIG. 2
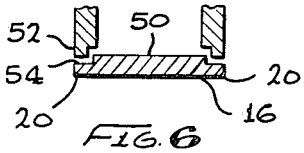
FIG. 6
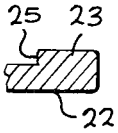
FIG. 7A
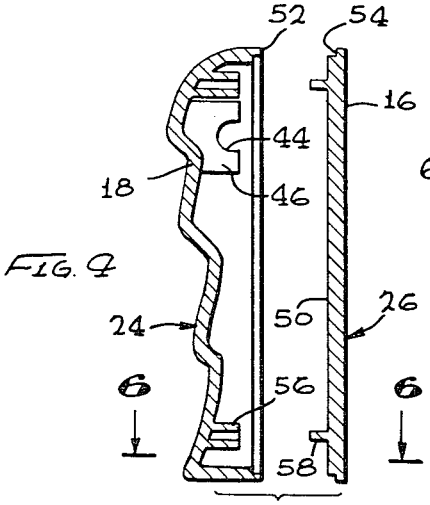
FIG. 4
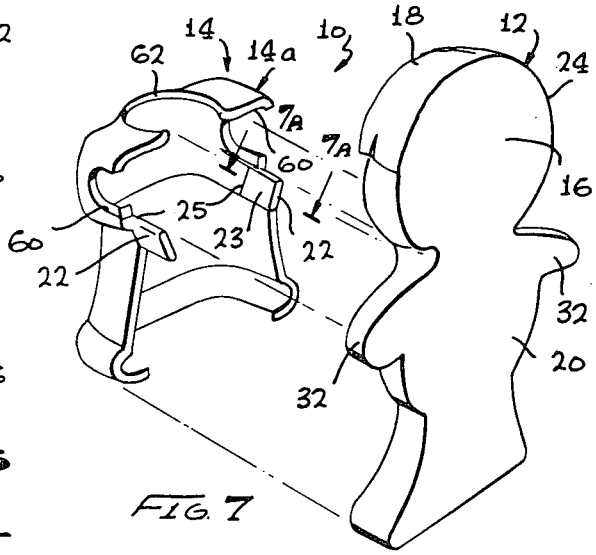
FIG. 7

FIG. 8A
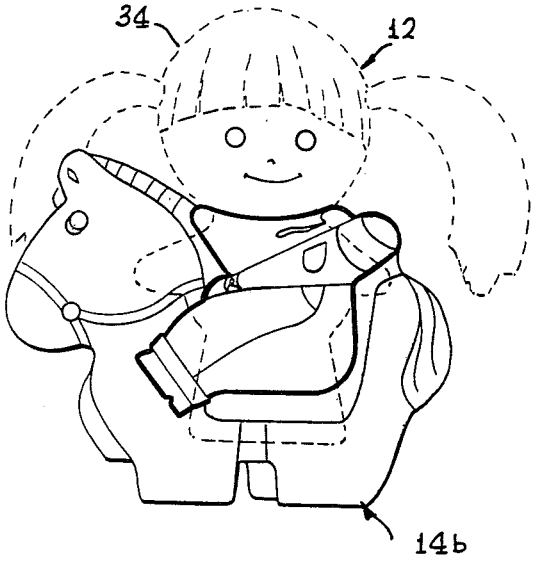
FIG. 8B
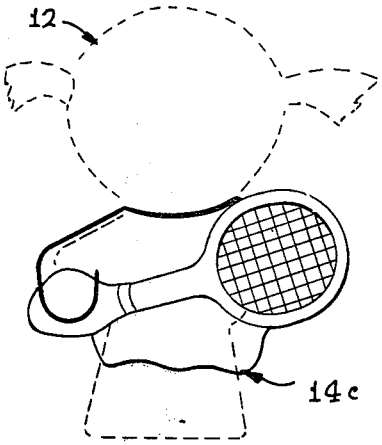
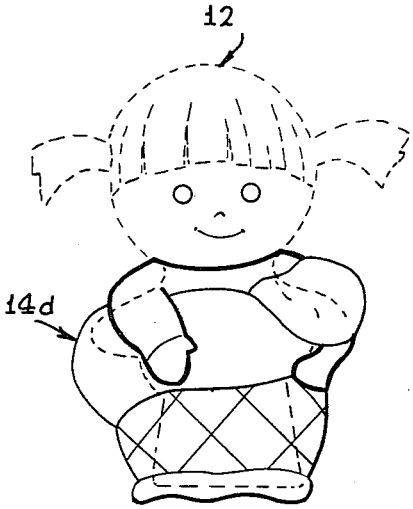
FIG. 8C
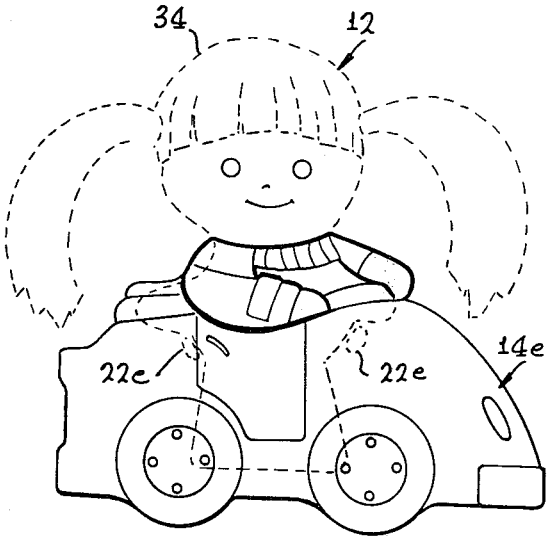
FIG. 8D

PLAY SET

This is a continuation-in-part of application Ser. No. 11,445, filed Feb. 12, 1979, now U.S. Pat. No. 4,227,340.

The present invention relates generally to a play set of the type comprising a doll or figure and a plurality of additional pieces which may be releasibly attached to the figure to provide different clothing or the like for the figure.

In the prior art there have of course been various forms of two dimensional paper dolls with selectively attachable clothing in the form of two dimensional or flat pieces. Similarly, there have been three dimensional dolls to which cloth or paper clothing could be releasibly attached.

Such prior art devices did not alter or change the basic appearance or pose of the doll figure but simply added such things as clothing, hats, hairdo's, shoes, etc. Such doll figures might be used with various accessories such as vehicles in which they could be positioned to ride, animals on which they could be positioned for riding, etc. To applicant's knowledge, none of these prior devices accomplished an actual change in the posturing of the dolls such as a change in the positions of their arms or legs.

The present invention contemplates the use of detachable pieces in conjunction with a doll figure to permit such change in the posturing of the figure as by changing the position of arms and/or legs in addition to any variation in clothing and/or providing a toy vehicle or a toy animal on which the newly posed doll figure could ride.

In the drawings:

FIG. 1 is a front elevational view of a three-dimensional doll figure in accordance with a presently preferred embodiment of the invention;

FIG. 2 is a front elevational view of the rear plate section of the doll figure;

FIG. 3 is a side elevational view of the front section of the doll figure;

FIG. 4 is a side sectional view taken generally along line 4—4 of FIG. 1 showing the front and rear sections of the doll figure;

FIG. 5 is a rear elevational view of the front section of the doll figure;

FIG. 6 is a transverse sectional view taken generally along line 6—6 of FIG. 4;

FIG. 7 is a perspective expanded view showing the doll figure and an article of molded clothing adapted to be detachably secured to the doll figure; and FIG. 7A is a section along 7A—7A.

FIGS. 8A, 8B, 8C and 8D show the doll figure detachably connected to various articles or pieces.

In general, the illustrated doll play set 10 comprises a three dimensional doll figure 12 and a plurality of three dimensional contoured articles or pieces 14 which may be detachably secured to the doll figure and which may depict different poses for the doll figure, different clothing for the doll figure, articles to be held or utilized by the doll figure and/or vehicles for the doll figure to ride in, and/or animals or the like for the doll figure to ride upon. The illustrated pieces 14 have a flexible resilient construction and they are adapted to snap or clip onto the doll figure 12. As shown best in FIG. 7, the illustrated doll figure 12 has a flat rear surface 16 and a three-dimensional contoured front surface 18. The peripheral edge of the flat rear surface 16 forms a shoulder

20 where that rear surface joins to the edge of the contoured front surface 18. This shoulder 20 may be utilized to engage suitable attaching means 22 on the attachable pieces 14.

Now to consider the illustrated toy figure 12 in further detail, that doll figure is shown in the drawing as being comprised of a contoured front section 24 and a plate-like rear section 26. Sections 24 and 26 are secured to one another to provide the toy figure 12. The parts 24 and 26 may be made of any suitable material such as molded plastic. The front section 24, as shown best in FIGS. 1 and 3, generally represents a small female figure having a body portion 28, a depending leg portion 30, outwardly extending arm portions 32 and a head portion, 34. The front section 24 may bear suitable indicia and be formed to provide features such as eyes, a mouth, a nose and hair for the doll figure. FIG. 3 shows an aperture 36 in either side of the head portion 34 of the front section 24. FIG. 1 illustrates a hair piece 38 which extends through said apertures 36 to provide a long tuft 40 of hair at either side of the head of the doll figure. FIG. 5 also shows the apertures 36 and broken line representation of the hair piece 38. The illustrated hair piece 38 is an elongated collection of simulated hair having the tufts 40 at either end which, as noted above, extend outwardly of the doll head. The hair piece also has a central section 42 which extends transversely across the interior of the head portion. The center hair section 42 extends through a pair of semi-circular notches 44 which open rearwardly from the rearward end of a rearwardly extending pair of tabs 46 secured to the inside of the doll head portion 34. A suitable clamp means 48 illustrated in FIG. 5 may be secured to the central section 42 of the hair piece between the tabs 46 to keep the hair piece from being pulled through in either direction. The hair piece 38 may be maintained in the semi-circular notches 44 by the interior surface 50 of the rear doll figure section 26.

FIG. 4 and FIG. 6 show side and plan views of the rear doll section 26 in alignment to be secured to the front doll section 24. More particularly, the front doll section 24 is formed with a rearwardly directed lip 52 extending rearwardly around its peripheral edge. The rear or plate section 26 of the doll figure is provided with a mating forwardly directed notch 54 which extends around its forwardly directed peripheral edge. Thus, when the rear plate section 26 is assembled with the contoured front section 24, the peripheral rib 52 is received in the peripheral notch 54 to establish and maintain proper alignment between the front and rear sections 24 and 26. In addition, the front section 24 is provided with four rearwardly extending receptables 56 which are adapted to receive aligned, forwardly extending pins 58 on the frontwardly facing surface 50 of the rear plate section 26. The locations of the pins 58 are illustrated in FIG. 2.

It will be noted that the doll figure 12 has a generally rectangular bottom surface which provides a base so that the doll figure may be self-standing on any suitable supported surface (not shown).

As noted above, FIG. 7 shows one contoured article 14*a* adapted to be releasibly secured to the doll figure 12. More particularly, the article 14*a* illustrated in FIG. 7 represents a full-length coat which will fit around and enclose the body and leg portions 28 and 30 of the toy figure 12 while permitting the arm portions 32 to extend outwardly therefrom through suitable openings 60. Similarly, a suitable opening 62 is provided at the top of the article 14*a* for the head portion 34 of the doll figure to extend through.

In general, the articles or pieces are desirably made of a resilient material so that they will flex or expand when they are assembled or attached to the doll figure and then will return to their original configurations, thereby maintaining interengagement to releasibly secure the article to the doll figure. The illustrated article 14*a* has attachment or retaining means in the form of a pair of spaced apart rearwardly extending projections or tabs 22. The illustrated tabs 22 are integral formed with the article 14*a* which may be injection molded of a plastic material such as styrene. At the rearward end of each tab 22 there is an inwardly directed or projecting portion 23 that defines a holding or retaining lip 25 (see FIG. 7A). The article 14*a* may be snapped or clipped onto the doll figure 12. In this regard, the article 14*a* and tabs 22 may flex slightly so that the portions 23 of the tabs 22 fit around the sides of the doll figure, with the retaining lip 25 then being positioned to interengage with the shoulder 20 to releasibly hold the article 14*a* on the doll figure. The illustrated tabs 22 extend beneath the arm portions 22.

It will be noted that the construction of the doll figure and of the articles, and the flexible resilient nature of the articles, provide a highly effective means for releasibly securing different articles to the doll figure. FIGS. 8*a*, 8*b*, 8*c*, and 8*d* illustrate various different articles 14 detachably secured to the doll figure 12.

FIG. 8A shows the basic doll figure 12 in broken line and shows, in solid line, a detachable piece or article 14*b* in the form of a toy horse for the figure to ride upon. In other words, the article 14*b* is a representation of a horse figure scaled to the size of the doll figure 12. It will be noted that the article 14*b* when it is attached to the doll figure 12 covers over the entire doll figure 12 except for the head portion 34. In particular, the body, arm and leg portions of the doll figure are covered over. As already noted, the covered over portions are represented by broken lines. The article 14*b* includes a representation of the remainder of the doll figure other than the head in a new different position and pose than the original pose of the doll figure. In this connection, the new pose of the doll figure is represented by heavy dark lines in FIG. 8A. The doll figure is thus represented sitting upon the toy horse with a leg directed forwardly and one arm raised at an upward, rearward angle. In addition, new clothes are provided for the doll figure by the article 14*b*. It will also be noted that the article 14*b* attaches to the doll figure 12 in such a way that the bottom of the doll figure no longer rests upon a supporting surface but is elevated above such surface while the article 14*b* itself rests on that surface to provide a base for the composite play item. Thus, not only are new clothes provided to the doll figure 12 but a new pose of the figure is provided which is different than the original pose and a toy horse is represented upon which the doll figured is represented as sitting and riding. The play value of such construction is readily apparent.

FIG. 8b shows the doll figure 12 again in broken line, with a clip-on article or piece 14*c* detachably secured thereon. This time the doll figure 12 is supported on its own bottom or base and the article 14*c* only partially covers the doll figure 12. The article 14*c* comprises a representation of a top body portion for the doll figure including a hand holding a tennis racket, the tennis racket itself, and appropriate clothing. The new or altered position of the arm of the doll figure is shown in solid dark line in FIG. 8B. This represents a different pose from the original one, partially shown by broken line in FIG. 8B.

FIG. 8C shows the doll figure 12 having a detachable article 14*d* secured thereto. The article 14*d* is a representation of a portion of a female figure in a large skirt holding a baby in her arms. In particular, there is a representation of a baby as well as a representation of arms for the figure in position holding the baby. These arm positions are shown in dark solid line in FIG. 8C and may be distinguished from the original arm positions of the toy figure 12 as shown in broken line in FIG. 8C.

FIG. 8D is still another representation of the doll figure 12 in broken line and a detachably secured article 14*e*. 14*e* represents a toy automobile and a new upper body portion for the doll figure seated within the automobile and holding a steering wheel. The representation of 14*e* is somewhat similar to the representation of the horse in FIG. 8A in that the doll figure 12 is elevated above the supporting surface and is covered over except for the head portion 34. The original position of the doll figure 12 is shown in broken line while the new position of the arms holding the steering wheel of the toy vehicle representation are shown in dark solid line in FIG. 8D.

Obviously, a great number of different forms of articles 14 may be provided for use with the doll figure 12. It will also be understood that suitable means for releasibly detaching the articles to the doll figure will be provided in each case and will vary somewhat because of the different shapes and sizes of the various articles. The articles 14*b* through 14*e* may be provided with resilient, flexible securing means such as the tabs 22 shown in FIG. 7. Thus, the case of article 14*e*, depicting the toy automobile, the tabs could be positioned as illustrated at 22*e* in FIG. 8D.

Various other modifications and changes may be made in the illustrated structure without departing from the spirit and scope of the present invention. In this connection, the particular appearance, form and construction of the doll figure may be varied as for example, to depict a male person.

What is claimed is:

1. A play set comprising:

(a) a three-dimensional doll figure having a front surface which is contoured and bears indicia to represent the figure, said front surface having a peripheral edge;

(b) a plurality of flexible, resilient, three-dimensional pieces for releasably attaching to said doll figure, each of said pieces having a contoured portion for overlying a major portion of the contoured front surface of the doll figure, each of said pieces also including retaining means for engaging said peripheral edge to releasably attach the piece to the doll figure, said retaining means for each of said pieces comprising a pair of spaced apart rearwardly extending portions that are positioned, when the piece is assembled on the doll figure, to interengage with said peripheral edge at opposite sides of the doll figure, each of said pieces and the associated engaging portions being integrally formed as a single molded plastic part that includes a three-dimensional representation of at least a portion of a limb of the doll figure, said doll figure being hollow and comprised of a front section providing the contoured front surface and a rear section providing a generally flat rear surface, said doll figure including an elongated collection of simulated hair protruding from either side of the head of the doll figure, said simulated hair collection being provided by a single elongated bundle of simulated hair, at least one of said sections being provided with an opening at either side for extension therethrough of said bundle, said play set further including means to retain said bundle in place, said retaining means comprising a band secured to an intermediate portion of said bundle, and a spaced apart pair of stop means on at least one of said sections and on opposite sides of said band each defining an opening large enough to receive the bundle therethrough but not large enough to receive the band therethrough.

* * * * *